United States Patent [19]

Pazdernik

[11] Patent Number: 4,917,663

[45] Date of Patent: Apr. 17, 1990

[54] PACKAGING MACHINE WITH DIRECT BLANK SETUP

[75] Inventor: Irvan L. Pazdernik, Alexandria, Minn.

[73] Assignee: APV Douglas Machine Corporation, Alexandria, Minn.

[21] Appl. No.: 198,053

[22] Filed: May 24, 1988

[51] Int. Cl.[4] ..... B31B 3/02; B31B 1/06

[52] U.S. Cl. ..... 493/416; 493/124; 493/317; 53/579; 271/12; 271/107; 414/737

[58] Field of Search ..... 53/50, 282, 578, 579, 53/228, 389; 271/12, 13, 107, 99, 102; 414/728, 737, 742; 493/122, 123, 124, 313, 315, 316, 317, 416, 418, 423, 441, 449

[56] References Cited

U.S. PATENT DOCUMENTS

| | | | |
|---|---|---|---|
| 2,827,287 | 3/1958 | Gross et al. | 271/12 |
| 3,287,011 | 11/1966 | Currie | 271/12 |
| 3,401,609 | 9/1968 | Nelson et al. | 271/107 |
| 4,066,009 | 1/1978 | Calvert et al. | 493/316 |
| 4,394,011 | 7/1983 | Dalton | 271/107 |
| 4,730,443 | 3/1988 | Matsuda et al. | 53/207 |
| 4,735,600 | 4/1988 | Drewke et al. | 493/314 |

FOREIGN PATENT DOCUMENTS

| | | | |
|---|---|---|---|
| 975233 | 10/1961 | Fed. Rep. of Germany | 271/107 |

*Primary Examiner*—William Terrell

*Attorney, Agent, or Firm*—Peterson, Wicks, Nemer & Kamrath

[57] ABSTRACT

A packaging machine and more particularly a machine for setting up a container from a blank (16) of corrugated board is disclosed as including a uniquely arranged magazine (10) for a plurality of container blanks (16) of corrugated board and including a structure to directly set up the shape of the container in a controlled manner for enabling a product to be easily loaded and for subsequent processing by the packaging machine. The unique direct setup arrangement utilizes arcuately moving arms (24) with vacuum cups (26) thereon which attach themselves to a blank (16) in the magazine (10) and move through an arc of less than 90° from a vertically inclined position to a generally horizontal position. The arms (24) and blank (16) are then moved horizontally so that the side edge portions of the major panel (18) of the blank (16), such as the bottom panel, are positioned under horizontal flap guides (74). The major panel (18) of the container is also positioned between upstanding lugs (28, 34) on a horizontal chain conveyor assembly (12) in order to orient the container flaps (20, 22) connected to the major panel (18) in perpendicular relation to the major panel (18). Thus, a partially formed container moves in a horizontal path with the chain conveyor assembly (12) for loading products into the partially formed container and for subsequently processing the container to form a package.

4 Claims, 3 Drawing Sheets

PACKAGING MACHINE WITH DIRECT BLANK SETUP

BACKGROUND OF THE INVENTION

1. Field of the Invention

The present invention generally relates to a packaging machine and more particularly a machine for setting up a container from a blank of corrugated board. Specifically, the packaging machine includes a uniquely arranged magazine for a plurality of container blanks of corrugated board and includes a structure to directly set up the shape of the container in a controlled manner for enabling a product to be easily loaded and for subsequent processing by the packaging machine. The unique direct setup arrangement utilizes arcuately moving arms with vacuum cups thereon which attach themselves to a blank in the magazine and move through an arc of less than 90° from a vertically inclined position to a generally horizontal position. The arms and blank are then moved horizontally so that the side edge portions of the major panel of the blank, such as the bottom panel, are positioned under horizontal panel guides. The major flap of the container is also positioned between upstanding lugs on a horizontal chain conveyor assembly in order to orient the container panel connected to the major panel in perpendicular relation to the major panel. Thus, a partially formed container moves in a horizontal path with the chain conveyor assembly for loading products into the partially formed container and for subsequently processing the container to form a package.

2. Information Disclosure Statement

Packaging machines to set up a container or box blank from its planar condition to a partially setup condition for receiving products and for further processing to complete the packaging is a well-known technique utilizing rather complex mechanical structures for controlling the flaps of the container for maintaining them in requisite position during the packaging process. Known devices feed one blank at a time from a supply stack, magazine or the like usually by moving the blank arcuately, 180° in some instances, and setting up and controlling the flaps by the use of cams, cam followers and the like. None of the prior art known to applicant utilizes arms which swing in an arc less than 90° to move the blank from a magazine to a position with the major panel received between pairs of projecting lugs on a chain conveyor assembly and which also move in a horizontal direction to move the blank so that the side edge portions of the major panel of the container are received under horizontal flap guides alongside the chain conveyor assembly.

SUMMARY OF THE INVENTION

An object of the present invention is to provide a packaging machine which forms a corrugated container blank from a flat, planar condition into a partially formed and accurately controlled shape for subsequent loading with product, either by hand or by subsequent portions of the packaging machine, and possibly for further processing to form a complete package, with the corrugated blanks being disposed in a vertically inclined magazine and moved directly from the magazine to a partially set up condition in a chain conveyor assembly.

Another object of the invention is to provide a packaging machine in which the magazine for the corrugated blanks is disposed in a generally vertical but inclined position oriented at a height generally the same as the upper flight of the chain conveyor assembly in order to enable the magazine to be more easily loaded with container blanks. The forwardly inclined angle of the magazine and blanks eliminate the necessity for a follower behind the blanks in order to keep them in position for movement by the arcuately moving arms to the horizontally oriented chain conveyor assembly.

A further object of the invention is to provide a packaging machine in accordance with the preceding objects in which the blank setup device includes arcuately moving arms having vacuum cups on the ends thereof which are moved toward a blank in the magazine and become attached to the blank for downward swinging movement in an arc less than 90° from the forwardly inclined position in the magazine to a generally horizontal position with the major panel of the container blank being moved downwardly between spaced pairs of upwardly projecting lugs on the chain conveyor assembly and with the arms simultaneously also moving horizontally to insert the outer side edge portions of the major flap of the blank container under panel guides extending horizontally alongside the chain conveyor assembly in order to gain and maintain complete control of the blank as it is set up and which enables the elapse of less time in each cycle of operation thereby increasing the efficiency of the packaging machine.

Still another object of the invention is to provide a packaging machine in accordance with the preceding objects in which the vacuum cup arms of the setup device are mechanically driven by a crank which not only moves the arms in an arcuate manner but also moves the arms horizontally on linear bearings. The arc of rotation of the arms is produced by cam followers moving in radiused tracks on opposite sides of the machine. Thus, accurate and positive control of all moving components and the corrugated container blanks is maintained as the blanks are moved from the magazine onto the conveyor chain assembly, with the blank being partially set up and accurately controlled for subsequent processing by the machine.

These together with other objects and advantages which will become subsequently apparent reside in the details of construction and operation as more fully hereinafter described and claimed, reference being made to the accompanying drawings forming a part hereof, wherein like numerals refer to like parts throughout.

DESCRIPTION OF THE PREFERRED EMBODIMENT

Figures 1A, 1B, 1C, 1D:
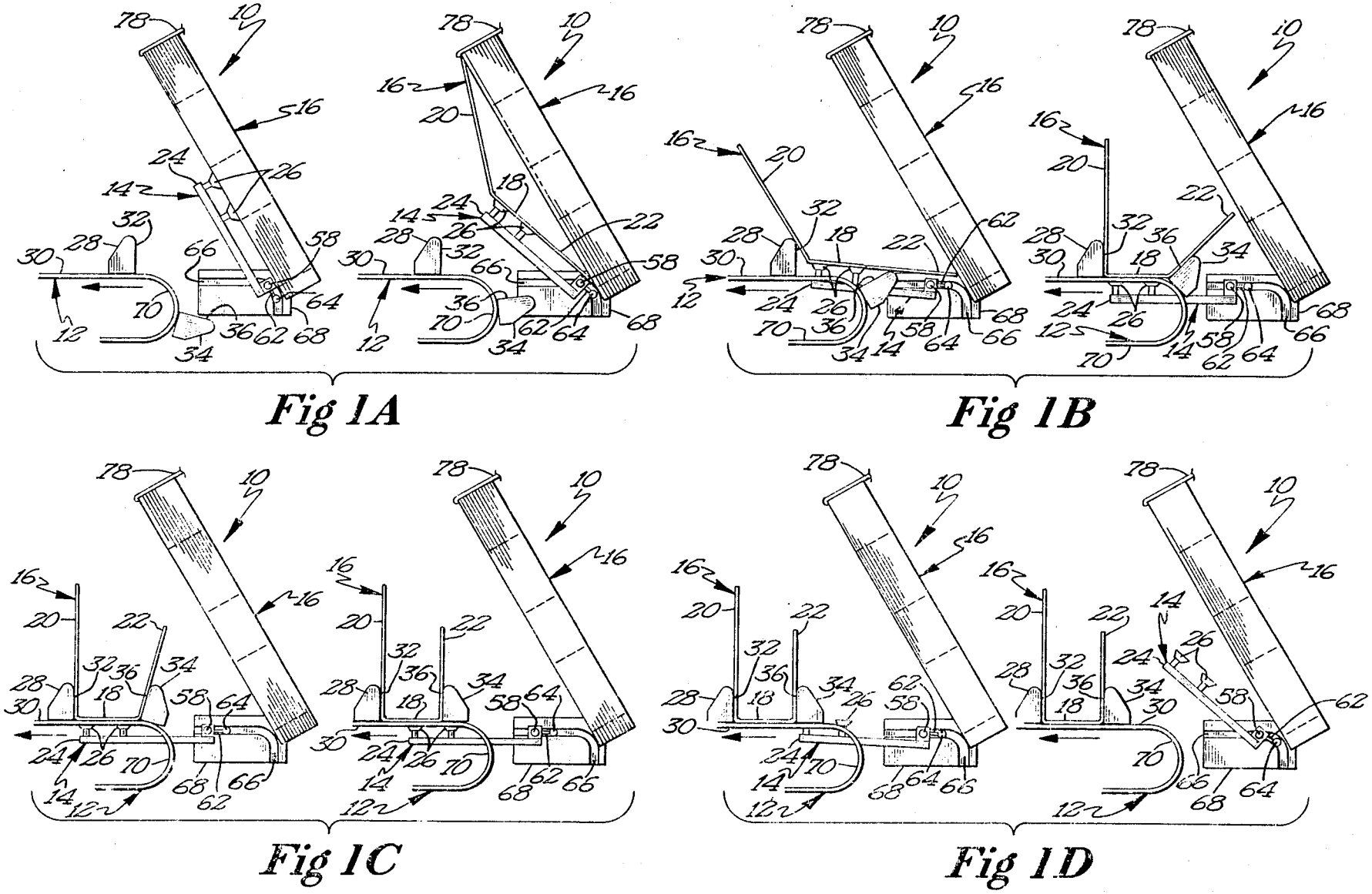
FIGS. 1A–D are progressive, schematic side elevational views illustrating the major components of a packaging machine according to the teachings of the invention removing a blank from a magazine and partially setting up the blank to a condition for receiving products or items to be packaged.

Referring now specifically to the drawings, FIG. 1 illustrates schematically the association and operation of the unique components of the present invention including a magazine generally designated by reference numeral 10 which is supported in vertically inclined position with the upper end being inclined toward a chain conveyor assembly 12 and including an arm assembly 14 which moves corrugated container or box blanks 16 from the magazine 10 onto the chain conveyor assembly 12. The box blank 16 is of planar construction before it is set up and includes a major panel 18 which may be the bottom of the container and additional panel(s) 20 and 22 which are moved from their initial position in the same plane as the major panel 18 to a position perpendicular thereto as shown in FIGS. 1C and 1D.

The arm assembly 14 includes arms 24 having vacuum cups 26 attached thereto which move toward and become attached to the major panel 18 of the corrugated blank 16, with the arms 24 then rotating or moving in an arcuate path downwardly from their initial position in FIG. 1A to the positions illustrated in FIGS. 1B and 1C. The arms 24 move downwardly in an arcuate path through an arc of movement of less than 90° from the vertically inclined position of FIG. 1A to the horizontal position of FIG. 1C. As the arms 24 move downwardly in an arcuate manner and remove the blank 16 from the magazine 10, the minor panel 20 is deformed upwardly in relation to the major panel 18. As the arms 24 reach a horizontal position, they are moved forwardly or in the direction of the chain conveyor assembly 12 so that the panel 20 comes into engagement with a leading projection or lug 28 mounted on the upper flight 30 of the chain conveyor assembly 12 which has a substantially vertical trailing edge 32. Trailing edge 32 of the lug 28 orients the panel 20 in perpendicular relation to the panel 18 as the blank 16 is moved toward the surface 32 of the lug 28. A trailing lug 34 having a vertical edge surface 36 facing the edge 32 of the lug 28 trails the lug 28, with lugs 28 and 34 operating in pairs so that the vertical edge 36 of the trailing lug 34 will contact and pivot the panel 22 upwardly into perpendicular relation to the panel 18 as illustrated in FIGS. 1C and 1D.

At the same time that the arms 24 and suction cups 26 are moving horizontally to bring the panel 20 into engagement with the edge 32 of the lug 28, it moves the blank 16 longitudinally and horizontally so that the side edge portions of the major panel 18 are received under longitudinally extending flap guides in the form of continuous flanges 74 mounted alongside of the chain conveyor assembly 12 thus maintaining control of the major panel 18. As soon as the side edge portions of the major panel 18 are received under and guided by the guide flanges 74 and the edges 32 and 36 of the lugs 28 and 34, respectively, engage the flaps 20 and 22 to orient the panel(s) 20 and 22 vertically in relation to the horizontal major panel 18, the blank 16 is then under complete control for movement along the chain conveyor assembly 12 for further processing by introducing products or other items to be packaged which can be easily moved laterally onto the upper surface of the major panel 18 by the machine or the products or items to be packaged can be manually placed in the partially set up container. The arm assembly 14 then returns toward the magazine 10 for attachment to another blank 16 for repeat of the cycle.

Figure 2:
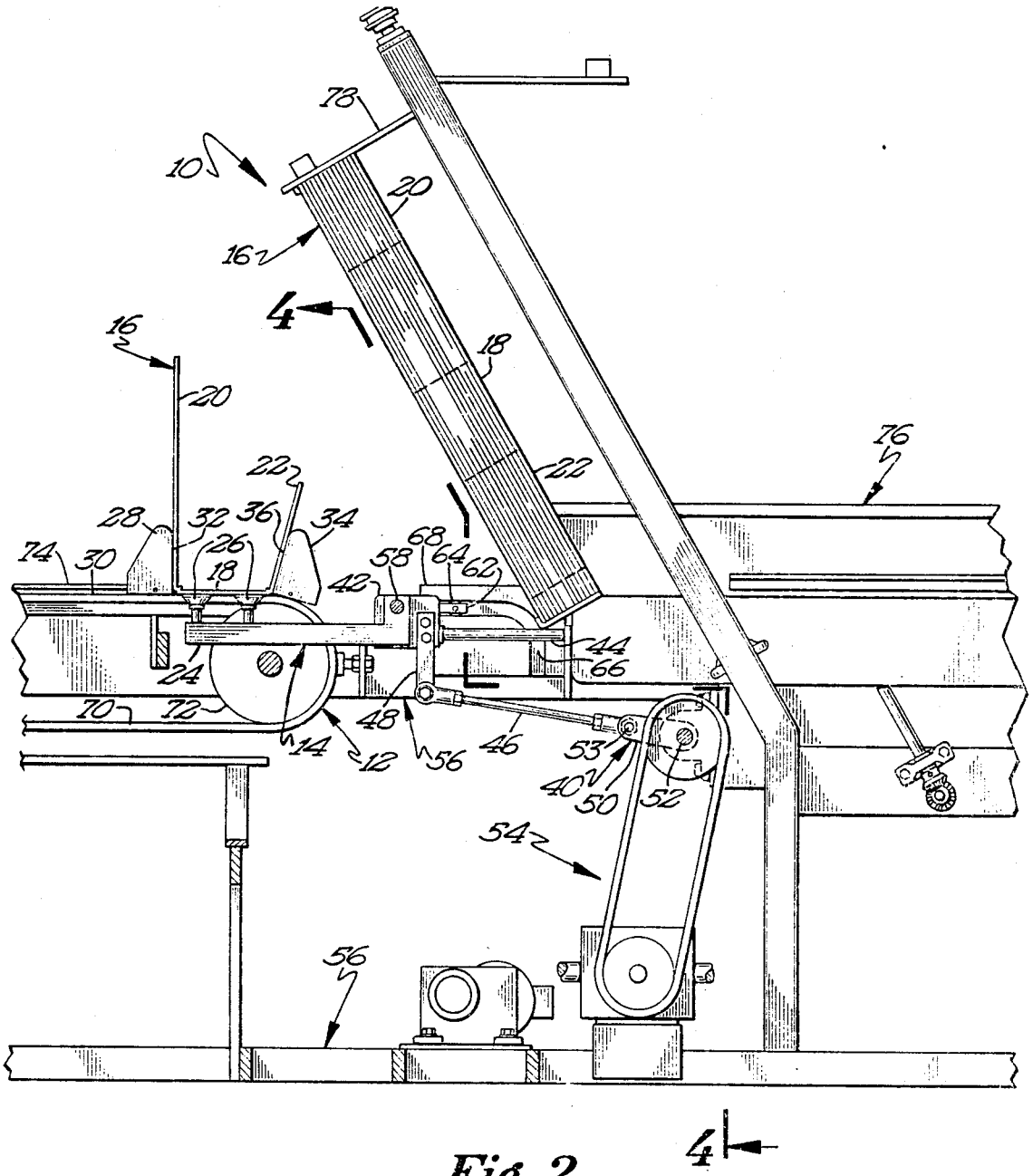
FIG. 2 is a side elevational view of the magazine and blank setup device according to the teachings of the present invention.
Figure 3:
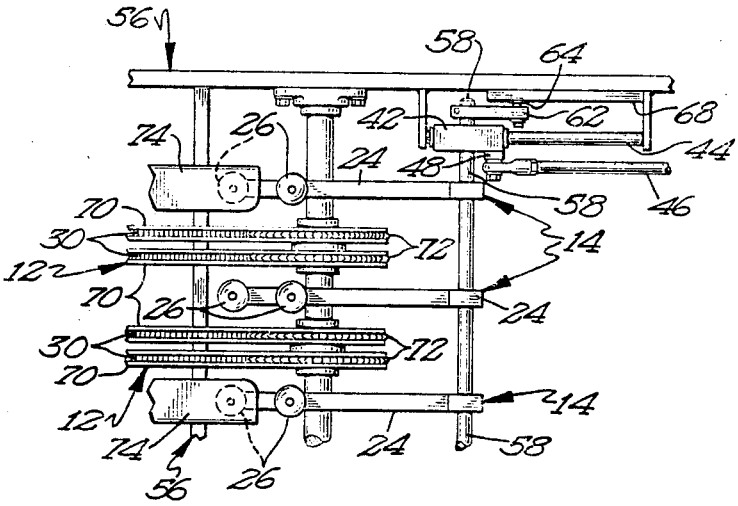
FIG. 3 is a plan view of the blank setup device of FIG. 2.
Figure 4:
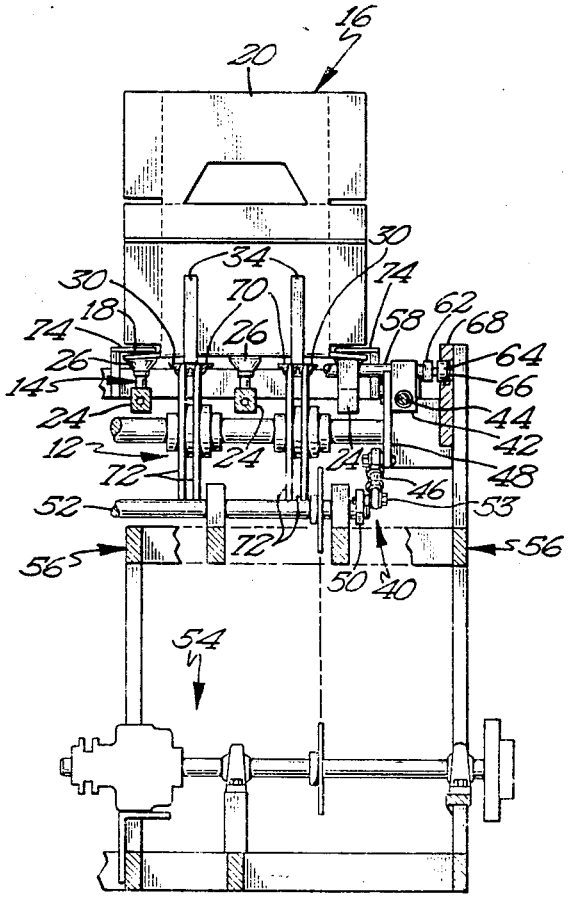
FIG. 4 is a sectional view of the blank setup device of FIG. 2 according to section line 4—4 of FIG. 2.

As illustrated in FIG. 2, the arms 24 are supported from a slide block 42 that slides on a linear bearing 44 in the form of an elongated rod. The slide block 42 is connected to a connecting rod 46 through an offset bracket 48. The connecting rod 46 is connected to a crank 50 rotatable about an axis defined by shaft 52. The crank 50 and connecting rod 46 are connected at pivot point 53 so that upon rotation of the shaft 52, the connecting rod 46 will cause the slide block 42 to reciprocate horizontally on the linear bearing rod 44. The shaft 52 is driven to reciprocate the slide block 42 and thus the arms 24 by a belt or chain drive assembly 54 that is supported on a framework structure 56 provided with a suitable motor, reduction gear and drive arrangement. The slide block 42 includes a transverse pivot shaft 58 on which the arms 24 are secured which enables the arms 24 to pivot about an axis defined by the shaft 58. A pair of roller-type cam followers 64 are mounted on laterally extending brackets 62 provided on the ends of the shaft 58. The cam followers 64 move in a radiused cam track 66 in a plate or other supporting structure 68. Thus, as the slide block 42 reciprocates forwardly, the cam followers 64 moving in the cam tracks 66 will move the arms 24 arcuately downwardly from the position illustrated in FIG. 1A to the generally horizontal position illustrated in FIG. 1C when the cam followers 64 are in the arcuate portions of the radiused cam tracks 66 about the axis defined by the shaft 58 and then also move them horizontally forward when both of the cam followers 64 are in the horizontal portion of the radiused cam tracks 66. Then, when the source of vacuum connected to the vacuum cups 26 is occluded in order to release the arms 24 from the major panel 18, as slide block 42 reciprocates rearwardly, the cam followers 64 moving in the cam track 66 will move the arms 24 horizontally rearward toward the magazine 10 when both of the cam followers 64 are in the horizontal portions of the radiused cam tracks 66 and then upwardly in an arcuate manner when the cam followers 64 are in the arcuate portions of the radiused cam tracks 66 so that the vacuum cups 26 again become attached to the next blank 16 when the source of vacuum is again connected with the vacuum cups 26. The position of the followers 64 in the cam tracks 66 is illustrated in FIGS. 1A–D and the position of the lugs 28 and 34 during the movement of the arms 24 during various stages of the cycle of movement of the blank 16 is also shown.

The chain conveyor assembly 12 includes two pairs of adjacent conveyor chains 70 entrained over end sprocket gears 72 journalled from side members of the framework 56 with the upper flight 30 of the conveyor chain 70 underlying the major flap 18 of the blank 16 as illustrated in FIG. 2. Also, the framework 56 includes the pair of flap guides 74 which extend alongside and are spaced outwardly slightly from the outermost upper chain conveyor flights 30 with the flap guides 74 overlying and controlling the position of the side edge portions of the major flap 18. Specifically, the flap guides 74 extend through and are received in inwardly extending slots formed in the side edge portions of the blank 16 at the juncture between the major panel 18 and panel(s) 20 and 22 thus gaining control of the blank 16 and maintaining control of the blank 16 as it moves from its setup position to a point on the machine for receiving the product or items to be packaged. The terminal end of the flap guide 74 is oriented generally in alignment with the inner periphery of the sprocket gears 72 so that the leading edge of the side edge portions of the major panel 18 will be inserted under the guide flaps or flanges 74 while the suction cups 26 still hold the major panel 18 downwardly against the upper flight 30 of the conveyor chains 70 as illustrated in FIG. 2 and at which point the lugs 32 and 34 have also completely partially formed the blank 16 into a container. The suction to the suction cups 26 can then be released in a known manner so that the arms 24 can move horizontally outwardly toward the magazine 10 until the cam followers 64 remote from the arms 24 engage the radiused and vertical portion of the cam tracks 66 and again pivot arms 24 upwardly to attach the suction cups 26 to the next blank 16 when vacuum is again communicated with the suction cups 26. The vacuum cups 26 may be solid so that the vacuum cups 26 can attach to the blank 16 without communicating any source of suction with them and also separated from the major flap 18 by sliding movement off of the bottom surface of the major flap 18 as the blank 16 moves with the conveyor chain assembly 12 and as the arms 24 move away from the conveyor chain assembly 12. As the partially formed container moves down the conveyor chain assembly 12, additional procedures are performed which do not constitute part of the present invention. These additional procedures include the positioning of items into the partially set up container either automatically by machine or manually with the container blank 16 then being completely formed into a container and closed in a manner to form a package.

The magazine 10 is fed by a feed conveyor assembly 76 which feeds the blanks 16 in vertical position into the inclined magazine 10. Magazine 10 includes a frame structure 78 supported in a suitable manner and having a bottom flange and top flange which engage and temporarily retain the top and bottom edges of the blank 16. Thus, the planar blank 16 when engaged by the suction cups 26 will break at the previously formed score lines between the major panel 18 and the flaps 20 and 22. The score lines terminate in the inwardly extending slots or notches through which the panel guides 74 extend. The side edge portions of the flaps 18, 20, and 22 may be folded inwardly and a top flap closed to form a complete package in the machine.

The essential component of the present invention reside in the magazine 10 and the setup device so that a supply of container blanks 16 can be formed into a predetermined shape in an efficient manner due to the particular inclined construction of the magazine 10 and the movement characteristics of the arms 24 and suction cups 26 and the relationship of the forming lugs 28 and 34 on the chain conveyor assembly 12. The magazine 10 eliminates the necessity of a follower since the inclined construction thereof will retain the blanks 16 in position for engagement by the suction cups 26 and enables the supply conveyor 76 to be loaded with blanks 16 in an efficient manner since the magazine 10 and supply conveyor 76 therefor is generally at the same height as the chain conveyor assembly 12. Another essential feature of the invention is the combined arcuate and horizontal movement of the arms 24 with vacuum cups 26 thereon for moving blanks 16 singly into a position along the top surface of the upper flight 30 of conveyor chains 70 having shaping lugs 28 and 34 arranged thereon in pairs. The lugs 28 and 34 of each pair are spaced to engage the blank 16 to partially form the blank 16 into a controlled shape with the side edge portions of the major panel 18 or bottom of the blank 16 being inserted under longitudinal flap guides 74 while still under the control of the arms 24 and vacuum cups 26. Positive and accurate control of the blank 16 is thereby maintained at all times from the magazine 10 until the blank 16 is loaded with product or items to be packaged.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. Method of retaining control of a container blank along a conveyor assembly in a packaging machine, with the blank including a major panel having side edge portions, with the conveyor assembly including an upper flight moving in a first direction, with the upper flight including a leading lug having an edge and a trailing lug having an edge with the edges of the lugs being spaced to engage the blank, with the conveyor assembly including longitudinally extending continuous guide flanges alongside the conveyor assembly to overlie the side edge portions of the major panel, with the longitudinally extending guide flanges having terminal ends, comprising the steps of:

(a) attaching the major panel of the blank to an arm assembly in a first position;

(b) moving the arm assembly with the attached blank in an arcuate path from the first position to a second position, with the major panel of the blank attached to the arm assembly and being positioned thereby between the leading and trailing lugs on the upper flight of the conveyor assembly and spaced from the terminal ends of the longitudinally extending guide flanges in the second position, with the blank being held on the upper flight by the leading and trailing lugs;

(c) moving the arm assembly with the attached blank in the first direction from the second position to a third position simultaneously as the blank located between the leading and trailing lugs moves on the upper flight in the first direction, with the side edge portions of the major panel of the blank attached to the arm assembly being inserted in the first direction under the longitudinally extending guide flanges by the arm assembly and the conveyor assembly as the arm assembly moves from the second position to the third position and as the blank moves on the upper flight in the first direction; and (d) releasing the major panel of the blank from the arm assembly when the arm assembly is in its third position and after the side edge portions of the major panel of the blank have been inserted under the guide flanges for movement with the conveyor assembly in the first direction.

2. The method of claim 1 wherein the packaging machine further includes a magazine supporting a plurality of blanks; wherein the attaching step comprises the step of attaching the major panel of the blank located in the magazine to the arm assembly when the arm assembly is in its first position; and wherein the step of moving the arm assembly from the first position comprises the step of moving the arm assembly from the first position to the second position removing the blank from the magazine.

3. The method of claim 2 wherein the blank further includes a first panel extending a length from the major panel, with the major panel being generally perpendicular to the leading lug and the first panel abutting the leading lug in the second position, and with the first panel being generally perpendicular to the major panel and with the major panel abutting the leading lug in the third position.

4. The method of claim 3 wherein the blank includes a second panel extending from the major panel, with the major panel being intermediate the first and second panel(s); and wherein the second panel is generally perpendicular to the major panel and parallel to and opposite the first panel when the blank is held on the upper flight by the leading and trailing lugs.

* * * * *